US007306126B2

(12) United States Patent
Brugner

(10) Patent No.: US 7,306,126 B2
(45) Date of Patent: Dec. 11, 2007

(54) MULTICOMPONENT CARTRIDGE

(75) Inventor: Nikolaus Brugner, Ziemetshausen (DE)

(73) Assignee: Sulzer Chemtech AG, Winterthur (CH)

( * ) Notice: Subject to any disclaimer, the term of this patent is extended or adjusted under 35 U.S.C. 154(b) by 413 days.

(21) Appl. No.: 10/891,412

(22) Filed: Jul. 14, 2004

(65) Prior Publication Data

US 2005/0051576 A1 Mar. 10, 2005

(30) Foreign Application Priority Data

Jul. 23, 2003 (DE) ..... 203 11 287 U

(51) Int. Cl.
*B67D 3/00* (2006.01)

(52) U.S. Cl. ..... 222/485; 220/506

(58) Field of Classification Search ..... 222/489, 222/485, 129, 145.1, 142.5, 137, 478, 482–484; 220/506, 526, 521, 523–525, 509–514, 500; 215/345, 343, 344

See application file for complete search history.

(56) References Cited

U.S. PATENT DOCUMENTS

| | | | | | |
|---|---|---|---|---|---|
| 3,200,995 | A * | 8/1965 | Gangwisch | ..... | 222/94 |
| 3,603,485 | A * | 9/1971 | Vivier | ..... | 222/129 |
| 3,856,138 | A * | 12/1974 | Maekawa et al. | ..... | 206/221 |
| 4,638,916 | A * | 1/1987 | Beck et al. | ..... | 215/235 |
| 5,209,348 | A * | 5/1993 | Schafer, III | ..... | 206/222 |
| 5,647,510 | A | 7/1997 | Keller | | |
| 5,897,840 | A * | 4/1999 | Owens et al. | ..... | 422/102 |
| 6,550,647 | B1 * | 4/2003 | Kunz | ..... | 222/129 |
| 6,889,857 | B2 * | 5/2005 | Francois et al. | ..... | 215/344 |
| 6,892,905 | B2 * | 5/2005 | Cousseau | ..... | 222/438 |
| 2002/0162859 | A1 | 11/2002 | Summons et al. | | |

FOREIGN PATENT DOCUMENTS

| | | | | |
|---|---|---|---|---|
| DE | 694 15 310 T2 | | 4/1999 | |
| EP | 117948 | * | 9/1984 | ..... 222/129 |
| FR | 2801870 | * | 12/1999 | ..... 222/129 |
| GB | 2298406 | * | 9/1996 | ..... 222/129 |
| JP | 2002-370781 | * | 12/2002 | ..... 222/129 |
| JP | 2003-81294 | * | 3/2003 | ..... 222/94 |
| WO | WO 01/09006 A1 | | 2/2001 | |

* cited by examiner

*Primary Examiner*—Lien M. Ngo
(74) *Attorney, Agent, or Firm*—Martin Fleit; Paul D. Bianco; Fleit Kain Gibbons Gutman Bongini & Bianco P.L.

(57) ABSTRACT

A multicomponent cartridge, particularly a two-component cartridge, contains a coaxial outlet with an outer outlet tube and an inner outlet tube concentric to the outer tube. A cap detachably connected to the coaxial outlet. A seal with at least one seal flange is arranged on the cap for contact on the inner and/or outer outlet tube. A simplified and improved seal is thus enabled, such that the seal includes at least one laterally projecting sealing edge, which extends around the inner and/or outer side of the inner and/or outer outlet tube of the coaxial outlet and/or on the side of the one or more seal flanges facing the outer and/or inner side of the inner and/or outer outlet tube.

20 Claims, 7 Drawing Sheets

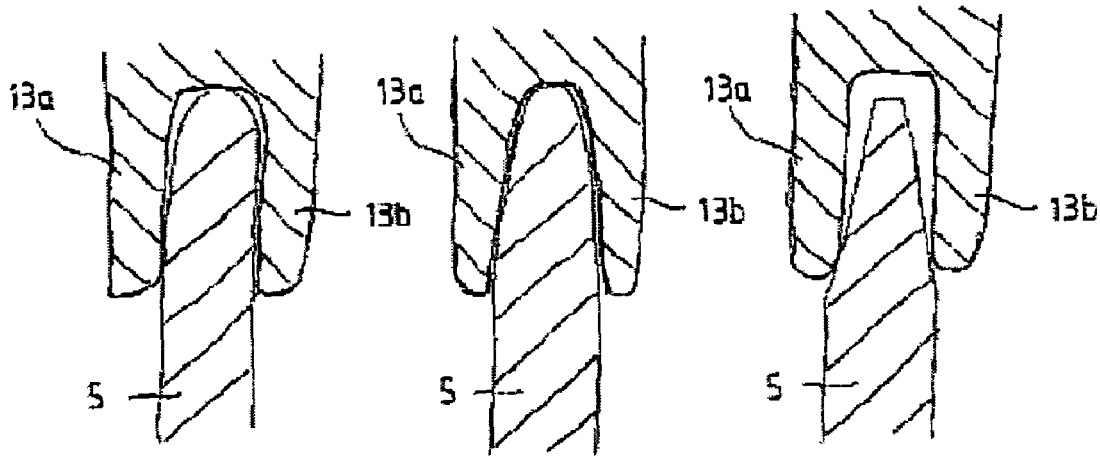
Fig. 6 (State of the art)
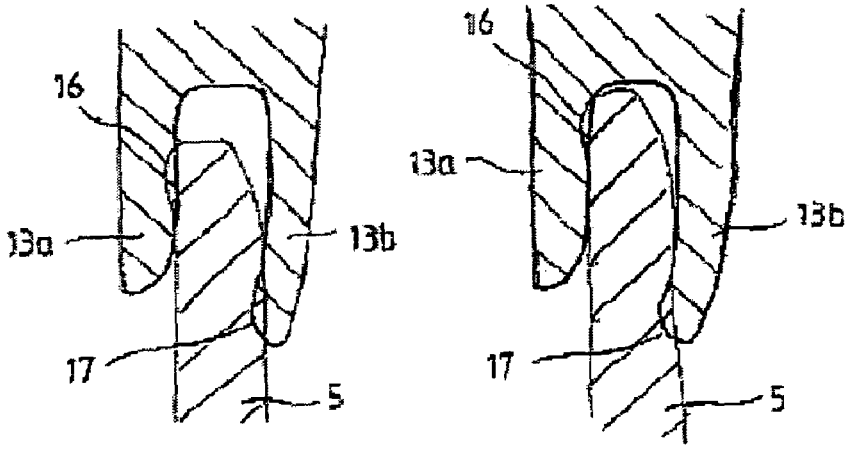
Fig. 7

MULTICOMPONENT CARTRIDGE

BACKGROUND OF THE INVENTION

1. Field of the Invention

The invention relates to a novel multicomponent cartridge, especially a two-component cartridge.

2. Prior Art

Such cartridges are used, e.g., for preserving and storing multicomponent adhesives, curing sealants, resins, or the like. The components are first mixed when squeezed out of the cartridge into a separate static mixer, which is set on the cartridge. Typical multicomponent cartridges have separate material receptacles and a material outlet with a seal that can be removed before use. This seal is removed first before emptying the cartridge and can be configured, e.g., as a screw cap, a tear-off seal, or the like. The material receptacles for such cartridges lie either side by side (side-by-side cartridge) or are configured as coaxial tubes (coaxial cartridge). In either embodiment, the material outlet can be configured as a coaxial outlet. In this way, the first component is discharged through a central tube and the other component is discharged through an annular space arranged around the central tube. Such coaxial outlets are sealed with caps, which have special sealing elements. The sealing elements should prevent the components stored in the cartridge from leaking during storage or from reacting with each other due to premature contact. Thus, a seal against the outside and a seal against the inside should be realized.

Cartridges are already known in which the seal between the cap and a coaxial outlet is realized by a planar arrangement of an inner and/or outer tube of the coaxial outlet inside of suitable annular grooves of the cap or by a wedge configuration. Here, the seal is realized on the end or on the side as a surface seal, on the side by a wedge configuration, or by a combination of these variants. FIG. 6 shows such seals. In the configuration shown in the sketch on the left of FIG. 6, the seal is realized on the end and/or on the side by means of a surface seal. The sketch on the right of FIG. 6 shows a wedge configuration, and the center drawing shows a combination of wedge and end-side sealing. One problem of such seals is that the wedge seal and the end-side seal are active only in a predetermined axial position. As soon as the cap is slightly opened, the sealing effect can no longer be guaranteed. Therefore, as a rule, the cap must be screwed down tightly to also exert sufficient force on the sealing position. The force of the surface seal is also distributed over a larger surface, so that an additional, high force for sealing the cap must be applied. The surface seal must also take into account capillary effects, and thus conditional loss of the sealing function. Consequently, the cap with the conventional sealing elements must be screwed down with much force for achieving the desired sealing effect, such that an additional auxiliary tool is sometimes necessary to open the cartridge. It has also been shown that loss of sealing function occurs again and again in the known cartridges, which can lead to leakage of the components and to blockage of the outlets due to reaction of the components.

There are already caps for cartridges with coaxial outlet, for which the seal is realized by an additional elastomer insert. However, this solution is expensive because an additional elastomer part must be produced and mounted in the cap or it must be produced using complicated 2K plastic injection technology.

SUMMARY OF THE INVENTION

The task of the invention is to create a multicomponent cartridge of the type mentioned in the introduction, which enables a simplified and improved seal.

This task is realized by a novel multicomponent cartridge with the features of the invention as described hereinafter. Preferred configurations and advantageous refinements of the invention are the objects of the invention.

The seal of the cartridge according to the invention is realized between the cap and the coaxial outlet by means of circular, lateral sealing edges. These are formed on the outlet tubes of the coaxial outlet and/or on the seal flanges or sealing elements of the cap. The seal is thus realized across a precisely defined and limited contact surface, so that a high surface pressure is produced on a small surface and therefore a higher sealing pressure is enabled. Because the seal acts laterally, excess tightening of the cap in the case of a screw cap is not necessary. Because the sealing edges lead to lateral contact at the corresponding counter-surfaces, a high sealing effect is also achieved without a great axial tightening force. If the cap is configured, e.g., as a screw cap, the seal itself then remains guaranteed when the cap is not completely screwed on. As long as the sealing edges contact the corresponding counter-surfaces, the seal remains guaranteed.

Preferably, the sealing edges are pre-tensioned in the radial direction. Therefore, the contact pressure can be increased. In a preferred configuration, seal flanges surrounding the outlet tubes are provided on the two sides of both outlet tubes. In this way, the sealing edges can be formed on the seal flanges, on the outlet tubes, or on both. However, merely a one-sided seal can also suffice. The sealing edges can be formed or set back on the ends of the seal flanges and/or outlet tubes. To guarantee a seal, one sealing edge can be sufficient. However, several sealing edges can also be provided. The sealing edge can be configured, e.g., with sharp edges or can be provided with strong or weak rounding. Other suitable shapes are also possible. In addition to the lateral seal with the sealing edges, an end-side seal can still also be achieved if the top edge surfaces of the outlet tube lead to contact at suitable counter-surfaces of the cap.

BRIEF DESCRIPTION OF THE DRAWINGS

Other details and advantages of the invention result from the following description of preferred embodiments with reference to the drawing. Shown are:

FIG. 6, examples of known seals between the coaxial outlet and the cap of a two-component cartridge;

FIG. 7, embodiments of seals according to the invention between the coaxial outlet and the cap of a two-component cartridge;

DETAILED DESCRIPTION OF PREFERRED SPECIFIC EMBODIMENTS OF THE INVENTION

Figure 1:
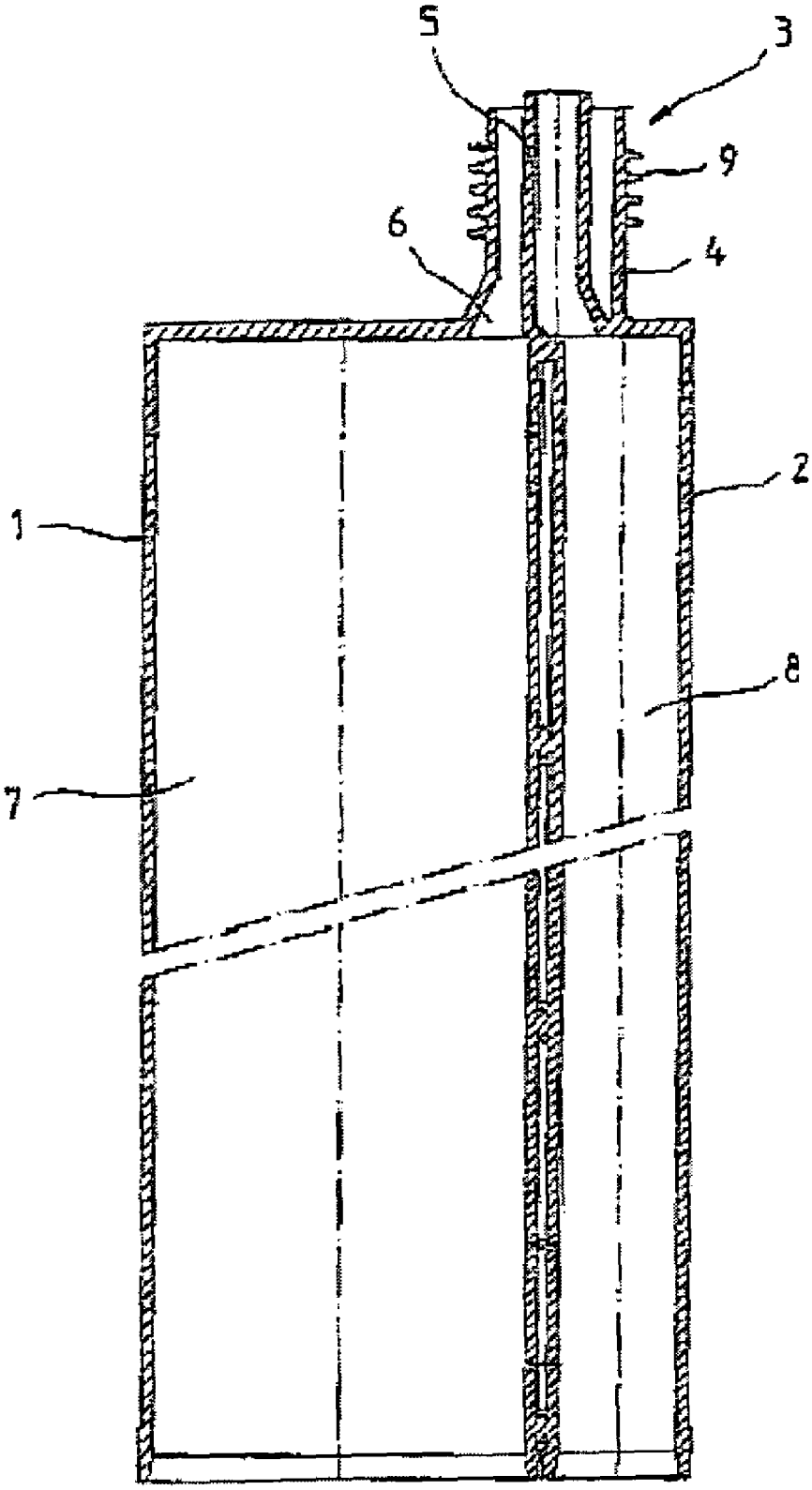
FIG. 1, a side-by-side cartridge with a coaxial outlet in longitudinal section.

FIG. 1 shows a so-called side-by-side two-component cartridge. It consists of two hollow, cylindrical housings 1 and 2 arranged in parallel and side by side, and also a coaxial outlet 3 with an outer outlet tube 4 and an inner outlet tube 5 arranged concentrically inside the outer tube. Between the outer outlet tube 4 and the inner outlet tube 5, an annular channel 6 is defined, which connects to the interior 7 of the housing 1. The inner outlet tube 5 opens into the interior 8 of the housing 2. Thus, the materials located in the interiors 7 and 8 can still be discharged separately by means of the outer outlet tube 4 and the inner outlet tube 5, respectively, of the coaxial outlet 3.

Figure 2:
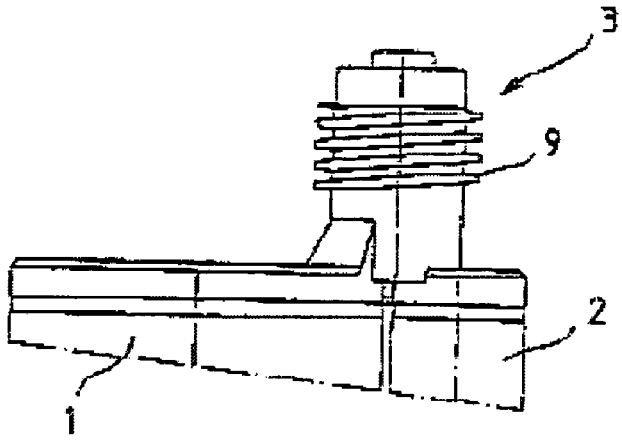
FIG. 2, the head part of the side-by-side cartridge shown in FIG. 1 in a side view.

As can be gathered especially from FIG. 2, external threads 9, which are used for fastening a static mixer, which is known and therefore not shown, are formed on the outer side of the coaxial outlet 3. For the embodiment shown in FIGS. 1-3, the threads 9 are also used for fastening a cap 10, which is shown in FIG. 3 and first unscrewed before actual use and prevents the components stored in the two-component cartridge from leaking during storage or from reacting with each other due to premature contact.

Figure 3:
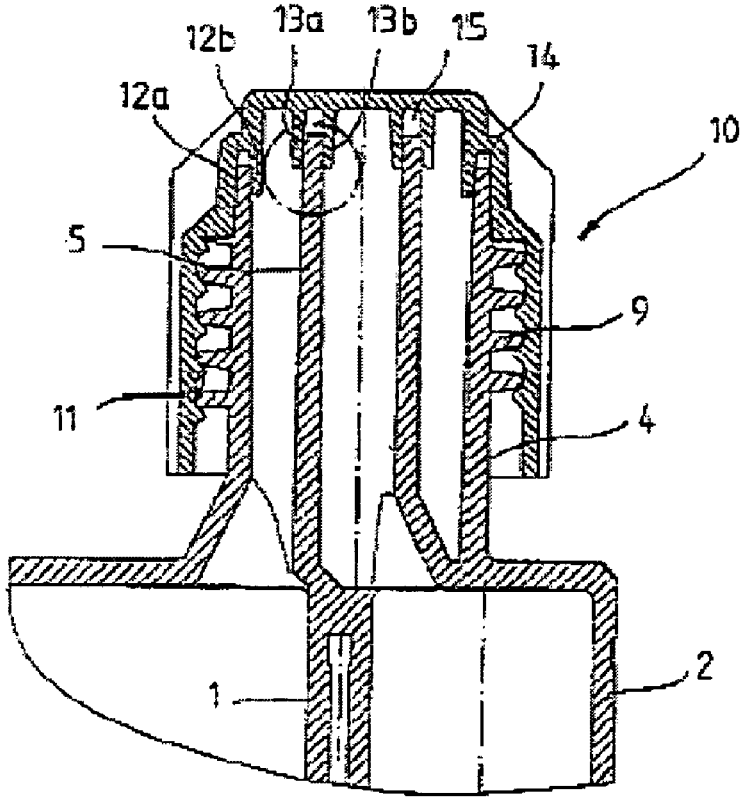
FIG. 3, the head part of the side-by-side cartridge shown in FIG. 1 with a cap in an enlarged longitudinal section.

The cap 10 shown in FIG. 3 is configured as a sealing cap and contains on its inside internal threads 11 matching the external threads 9 of the coaxial outlet 3 and annular, circular seal flanges 12*a*, 12*b*, 13*a*, 13*b*, which define annular grooves 14 and 15 for the outer outlet tube 4 and the inner outlet tube 5, respectively. For the shown embodiment, the inner outlet tube 5 projects upwards relative to the outer outlet tube 5. Correspondingly, the seal flanges 13*a* and 13*b* of the cap 10 are also arranged above the seal flanges 12*a* and 12*b*. This can better prevent contact between the components located in the cartridge also for reclosing of the cap 10. The configuration of the seal flanges and/or the inner or outer tube for guaranteeing a good and reliable seal is explained in more detail in the following.

Figure 4:
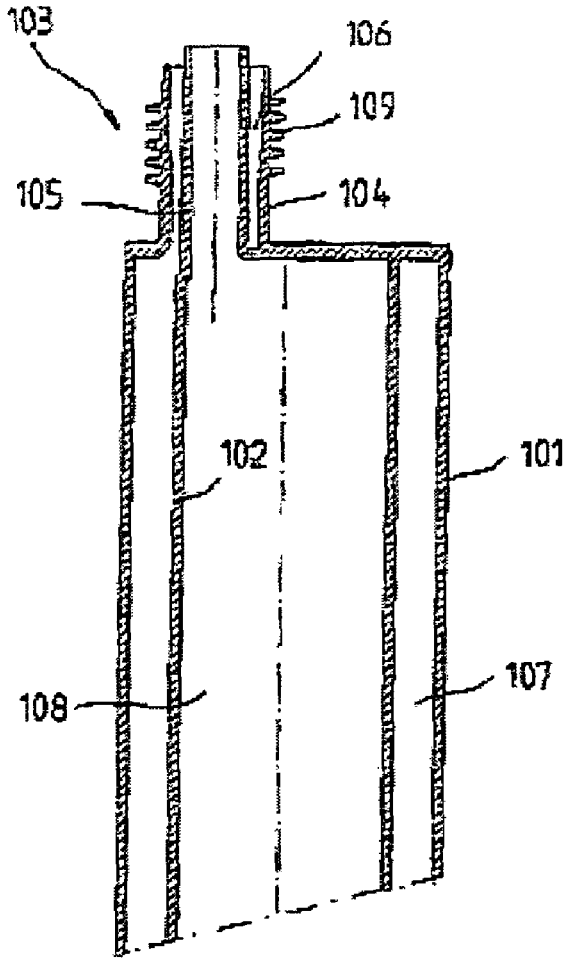
FIG. 4, the top part of a coaxial cartridge with a coaxial outlet in the longitudinal section.

In FIG. 4, a so-called two-component coaxial cartridge is shown as an additional embodiment. This cartridge produced from plastic in one part, e.g., in an injection-molding process, contains two tubes 101 and 102 arranged coaxially to each other with different diameters, where the tube 102 of smaller diameter is located within the tube 101 of larger diameter. A radially outer annular space 107 is defined between the outer tube 101 and the inner tube 102, and an inner receptacle space 108 is defined by the inner housing 102. This cartridge also contains a coaxial outlet 103, which contains an outer outlet tube 104 provided with external threads 109 and a central, inner outlet tube 105 arranged coaxially inside the outer tube. An annular channel 106, which connects to the outer annular space 107, is also defined there between the outer outlet tube 104 and the inner outlet tube 105. The inner outlet tube 105 opens into the inner receptacle space 108.

Figure 5:
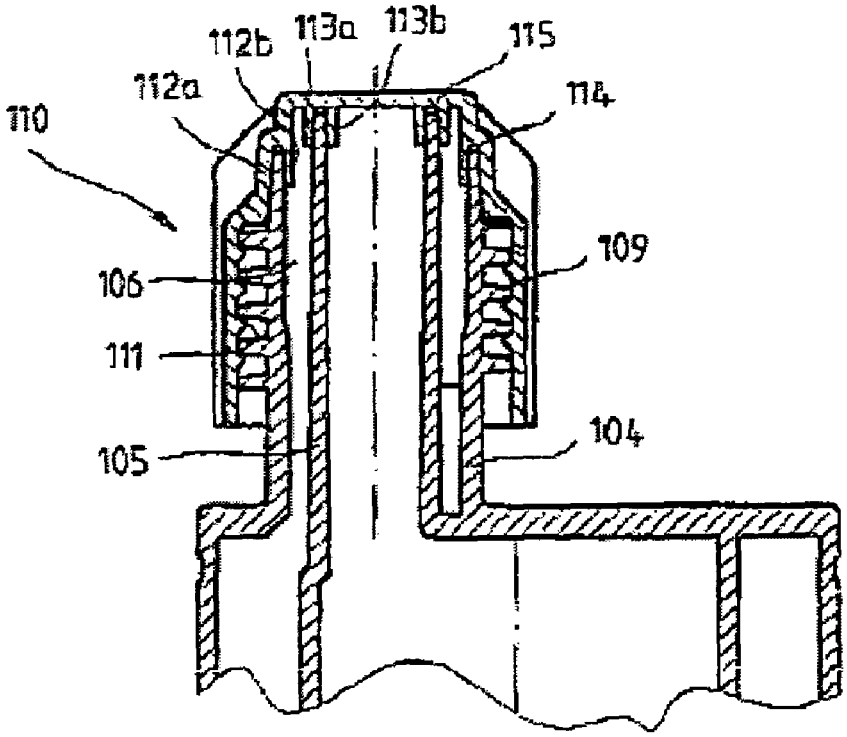
FIG. 5, the head part of the coaxial cartridge shown in FIG. 4 with a cap in an enlarged longitudinal section.

FIG. 5 shows a cap 110 for the cartridge shown in FIG. 4, wherein this cap 110 is designed as the cap 10 shown in FIG. 3. It also contains internal threads 111 matching the external threads 9 of the coaxial outlet 3 and annular, circular seal flanges 112*a*, 112*b*, 113*a*, 113*b*, which define annular grooves 114 and 115 for the outer outlet tube 104 and the inner outlet tube 105, respectively.

The configuration of the seal between the cap and the coaxial outlets of the corresponding cartridges is explained in the following with reference to several embodiments shown in FIGS. 7-12. In these figures, by way of example only, the top part encircled in FIG. 3 of the inner outlet tube 5 of the cartridge shown in FIG. 1 with the appropriate seal flanges 13*a* and 13*b* of the cap 10 is shown. However, it should be mentioned that the configurations shown there and explained below apply or can apply in a corresponding way also to the outlet tube 4 and/or the appropriate seal flanges 12*a*, 12*b* and the other embodiments of cartridges.

For the embodiments shown in FIG. 7, sealing edges 16, 17, which project to the side and in the circumferential direction, are provided for contact on the relevant counter piece on the outer side of the outlet tube 5 and on the inner side of the inner seal flange 13*b* in the radial direction. On the outer side of the outlet tube 5, there is a sealing edge 16 for contact to the inner side of the radially outer seal flange 13*a*; on the inner side of the radially inner seal flange 13*b*, there is a sealing edge 17 for contact to the outer side of the outlet tube 5. However, the sealing edge 16 can also be provided on the inner side of the outlet tube 5, and the sealing edge 17 can be provided on the inner side of the radially outer seal flange 13*a*. Sealing edges can also be provided on both sides of the outlet tube 5 and on both seal flanges 13*a* and 13*b*. For the configuration shown in the sketch on the left, a lateral seal is achieved, while in the configuration shown on the right, an additional end-side seal is also enabled. The seal flange 13*b* is bent inwardly in the configuration shown, so that the sealing edges 16 and 17 lead to contact under pre-tensioning.

Figure 8:
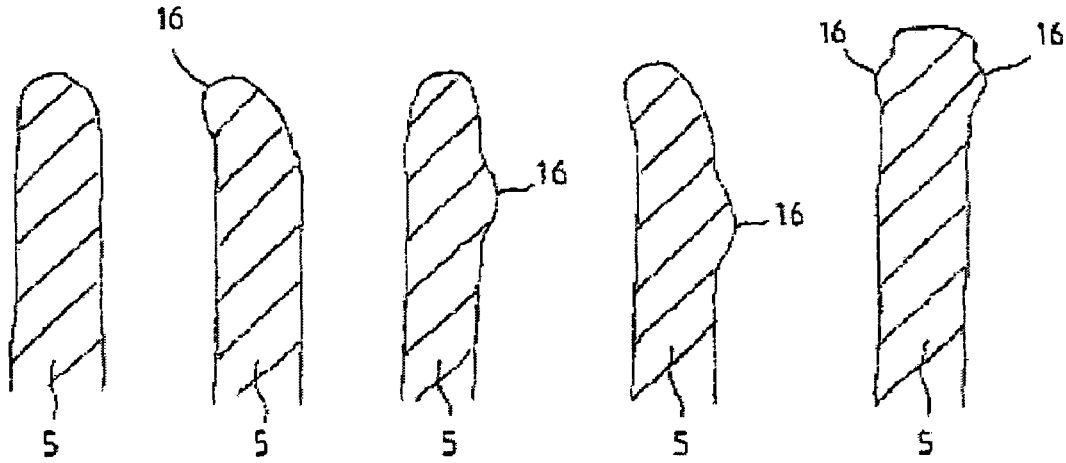
FIG. 8, examples of sealing edge configurations on the tubes of the coaxial outlet.

Different embodiments for the sealing edges provided on the inner and/or outer outlet tube are shown in FIG. 8, using the example of the inner outlet tube 5. As can be gathered from these sketches, the sealing edge 16 can be provided on the inner and/or outer side of the outlet tube 5. The outlet tube also need not have a sealing edge according to the sketch on the left, if a sealing edge 17 is provided on at least one of the associated seal flanges 13*a*, 13*b*. The lateral sealing edges 16 can be arranged on the top end of the outlet tube or offset downwards. Sealing edges 16 arranged on both sides can be offset relative to each other in the axial direction of the outlet tube or, as shown in the sketch on the right, arranged opposite each other.

Figure 9:
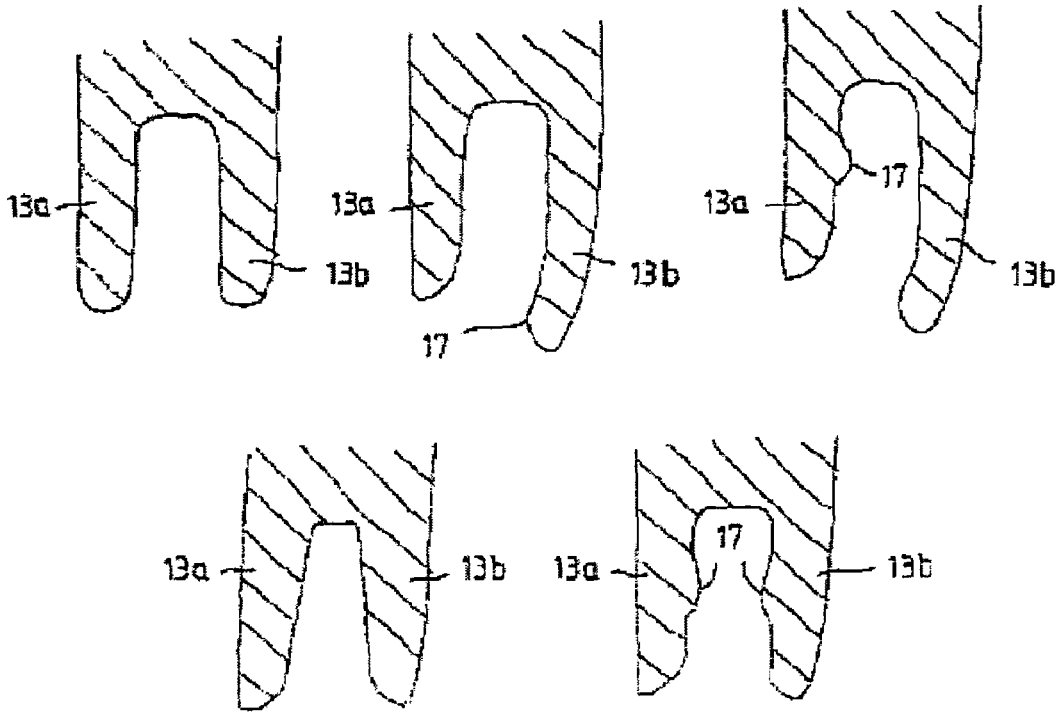
FIG. 9, examples of sealing edge configurations on the seal flanges of the cap.

As can be gathered from FIG. 9, the sealing edge 17 of the cap can be on the radially outer seal flange 13*a*, on the radially inner seal flange 13*b*, or on both seal flanges 13*a*, 13*b*. If at least one sealing edge 16 is provided on the associated outlet tube, then no cap-side sealing edge is needed on the seal flanges, as shown in the two sketches on the left.

Figure 10:
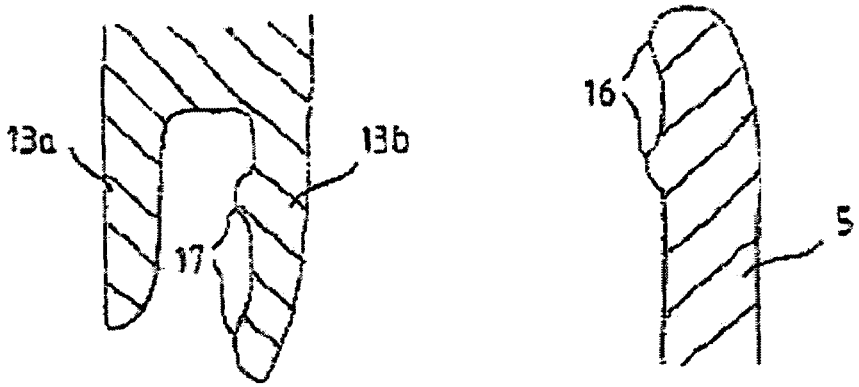
FIG. 10, examples of sealing edge configurations with several sealing edges.

In FIG. 10, two embodiments are shown, for which two sealing edges 16 and 17 lying one behind the other are arranged on the outlet tube 5 or seal flange 13*b*.

Figure 11:
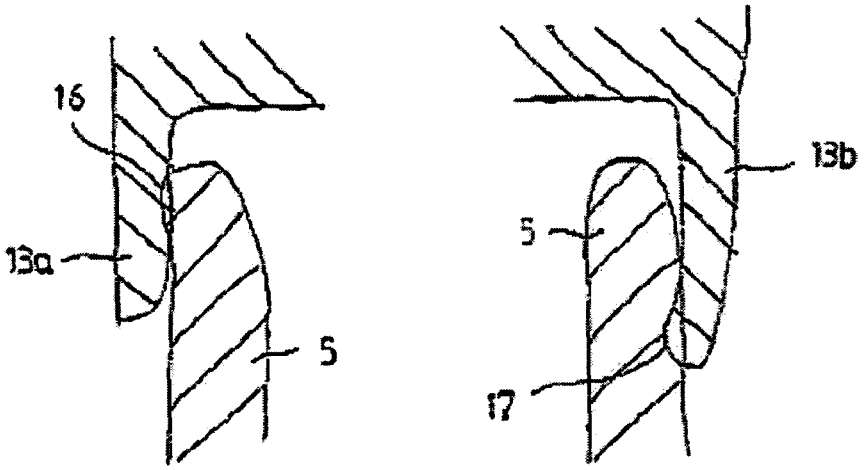
FIG. 11, embodiments with one-sided sealing.

FIG. 11 shows two embodiments with only one seal flange 13*a* or 13*b*. For these configurations, according to the sketch on the left, a lateral sealing edge 16 for contact on the inner side of the seal flange 13*a* is provided on the outlet tube 5 and according to the sketch on the right, a sealing edge 17 for contact on the outer side of the outlet tube 5 is provided on the inner side of the seal flange 13*b*.

Figure 12:
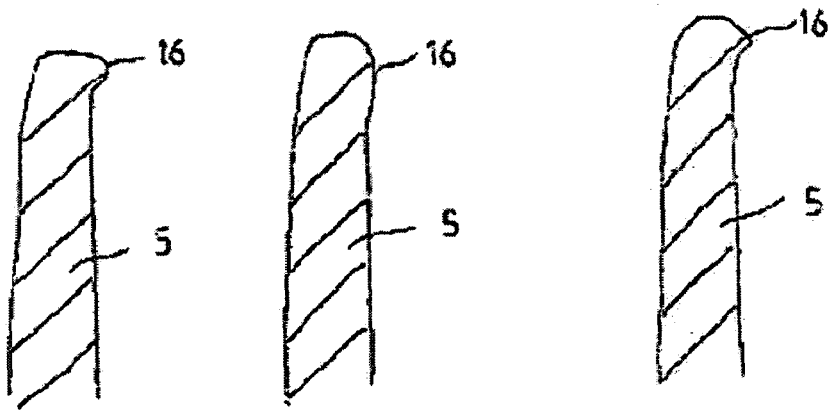
FIG. 12, embodiments of sealing edges.

Various configurations of the sealing edge 16 or 17 are shown in FIG. 12 using the example of the sealing edge 16 on the outlet tube 5. This can have, e.g., a small rounding shown in the sketch on the left, a great rounding shown in the center drawing, or a sharp edge shown in the sketch on the right.

Figure 13:
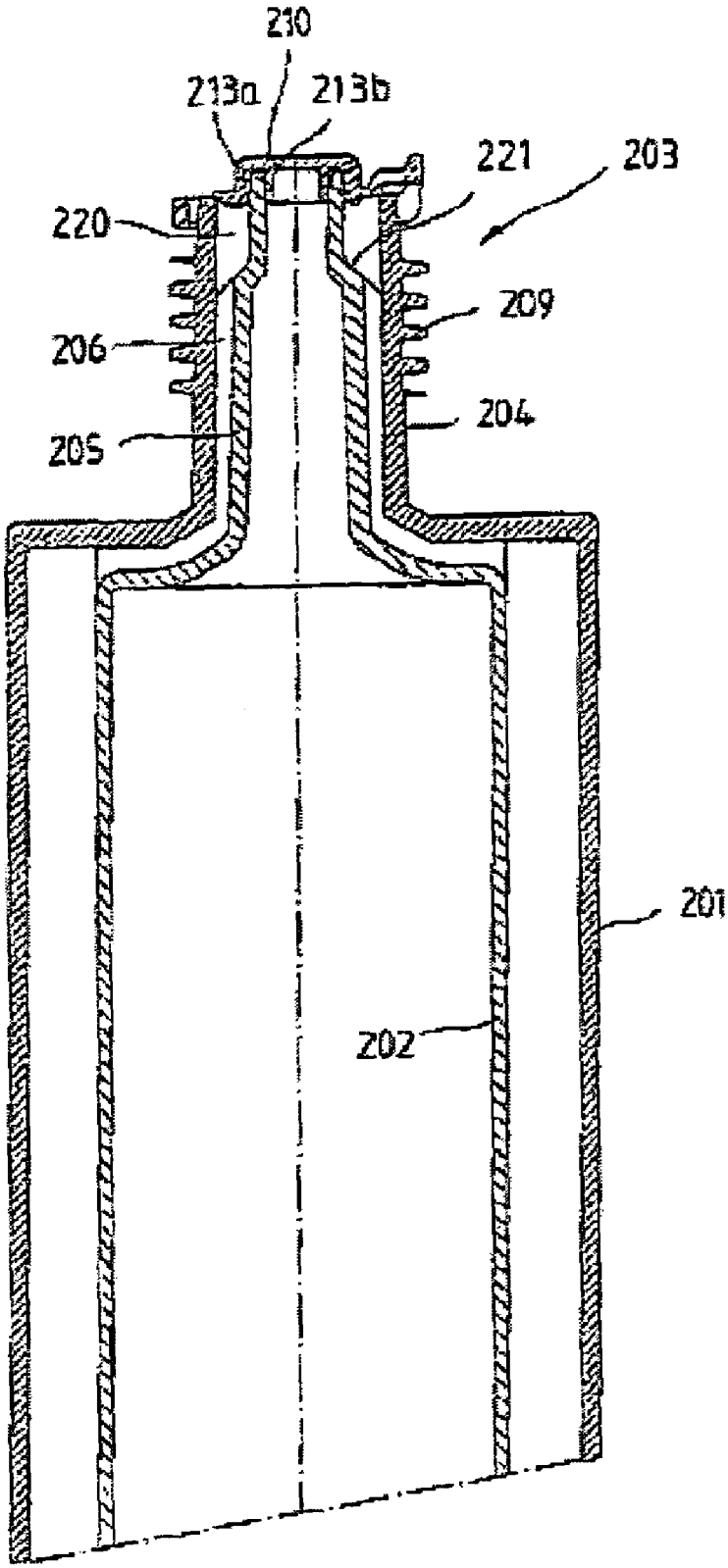
FIG. 13, an embodiment of a two-part coaxial cartridge with a tear-away cap.

FIG. 13 shows another embodiment of a coaxial cartridge. This contains an outer cartridge housing 201 with a narrower outer outlet tube 204 formed at the top and an inner cartridge housing 202, which is arranged within the outer cartridge housing 201 concentric to this outer housing and contains a central, inner outlet tube 205 arranged within the outlet tube 204. The outer outlet tube 204 and the inner outlet tube 205 form a coaxial outlet 203, which is formed according to the embodiment of FIG. 4. Here, an annular channel 206 is also defined between the outer outlet tube 204 and the inner outlet tube 205 for discharging the components located in the outer cartridge housing 201, while the components located in the inner cartridge housing 202 are discharged through the outlet tube 205. In the end region of the channel 206, several projections 220 are distributed along the circumference of the outer outlet tube 204, on which an inner shoulder 221 of the inner outlet tube 205 is supported, wherein the position of the two cartridge housings 201 and 202 is fixed in the axial direction. On the outer side of the outer outlet tube 204, threads 209 are formed for screwing on a static mixer.

In this embodiment, the cap is configured as a molded sealing cap 210. Here, only sealing of the inner outlet tube 205 is necessary. The sealing cap also contains seal flanges 213*a* and 213*b*, which define an annular groove for the inner outlet tube 205. There, the seal corresponding to the previously described embodiments can also be configured between the sealing cap and the inner outlet tube 205. The outer outlet tube 204 is connected integrally to the sealing cap 210, wherein the sealing cap 201 can be opened by tearing or also by separation according to the configuration.

The invention is not limited to the previously described embodiments. In particular, any combination of the sealing configurations described individually and shown in the figures can be provided.

What is claimed is:

1. A multicomponent cartridge, especially a two-component cartridge, comprising:

a coaxial outlet defined by an outer outlet tube and an inner outlet tube concentric to the outer outlet tube;

a screw cap detachably connected to the coaxial outlet; and a seal with at least two seal flanges arranged on the cap for contact to at least one of the inner and outer outlet tube, the seal including at least one sealing edge, pre-tensioned in a radial direction, which projects to a side and extends around at least one of the inner and outer side of the at least one of the inner and outer outlet tube of the coaxial outlet, and/or on the side of the one or more seal flanges facing at least one of the outer and inner side of the at least one of the inner and outer outlet tube.

2. The multicomponent cartridge according to claim 1, characterized in that the cap contains the at least two seal flanges with one or more scaling edges for the at least one of the outer and inner tube.

3. The multicomponent cartridge according to claim 1, characterized in that the cap contains two seal flanges defining an annular groove for at least one of the inner and outer outlet tube.

4. The multicomponent cartridge according to claim 3, characterized in that one or more sealing edges arc arranged on the seal flanges defining the annular groove.

5. The multicomponent cartridge according to claim 1, characterized in that the seal contains at least one circular scaling edge on the at least one of the inner and outer outlet tube.

6. The multicomponent cartridge according to claim 1, characterized in that the scaling edge is configured with a sharp edge.

7. The multicomponent cartridge according to claim 1, characterized in that the sealing edge is rounded.

8. The multicomponent cartridge according to claim 1, characterized in that the cap is connected by a screw connection to the coaxial outlet.

9. The multicomponent cartridge according to claim 1, characterized in that the cap is connected by a tear-away connection to the coaxial outlet.

10. A multi-component cartridge, comprising:

a first cylindrical housing for retaining a first substance;

a second cylindrical housing for retaining a second substance;

a coaxial outlet defined by an outer outlet tube communicatively coupled to the first cylindrical housing and an inner outlet tube concentric to the outer outlet tube and communicatively coupled to the second cylindrical housing, wherein the coaxial outlet extends outward from first cylindrical housing and the second cylindrical housing, and wherein the inner outlet tube projects outward beyond the outer outlet tube within the coaxial outlet;

a screw cap detachably connected to the coaxial outlet; and a seal with at least two seal flanges arranged on the cap for contact to at least one of the inner and outer outlet tube, the seal including at least one sealing edge, pre-tensioned in a radial direction, which projects to a side and extends around at least one of the inner and outer side of the at least one of the inner and outer outlet tube of the coaxial outlet, and/or on the side of the one or more seal flanges facing at least one of the outer and inner side of the at least one of the inner and outer outlet tube.

11. The multi-component cartridge according to claim 10, characterized in that the screw cap contains the at least two seal flanges with one or more scaling edges for the at least one of the outer tube and the inner tube.

12. The multi-component cartridge according to claim 10, characterized in that the screw cap contains two seal flanges defining an annular groove for at least one of the inner tube and the outer outlet tube.

13. The multi-component cartridge according to claim 12, characterized in that one or more sealing edges are arranged on the seal flanges defining the annular groove.

14. The multi-component cartridge according to claim 10, characterized in that the seal contains at least one circular sealing edge on the at least one of the inner outlet tube and the outer outlet tube.

15. The multi-component cartridge according to claim 10, characterized in that the sealing edge is configured with a sharp edge.

16. A multi-component cartridge, comprising:

a coaxial outlet defined by an outer outlet tube and an inner outlet tube concentric to the outer outlet tube;

a screw cap detachably connected to the coaxial outlet; and a seal with at least a first set of seal flanges and a second set of seal flanges arranged on the cap for contact to at least one of the inner and outer outlet tube, each of seal flange in the first set of seal flanges and the second set of seal flanges including at least one sealing edge which projects to a side and extends around at least one of an inner side and an outer side of the at least one of the inner and outer outlet tube of the coaxial outlet, and/or on the side of the one or more seal flanges facing at least one of the outer side and inner side of at least one of the inner and outer outlet tube, wherein the at least one sealing edge is pre-tensioned in a radial direction for providing the seal between the outer outlet tube and the inner outlet tube when the screw cap is only partially screwed down onto the coaxial outlet.

17. The multi-component cartridge of claim 16, wherein the first set of seal flanges comprises a first seal flange and a second seal flange, wherein the first seal flange contacts and extends around the outer side of the outer outlet tube and the second seal flange contacts and extends around the inner side of the outer outlet tube.

18. The multi-component cartridge of claim 16, wherein the second set of seal flanges comprises a first seal flange and a second seal flange, wherein the first seal flange contacts and extends around the outer side of the inner outlet tube and the second seal flange contacts and extends around the inner side of the inner outlet tube.

19. The multi-component cartridge of claim 16, wherein the first set of seal flanges project outward beyond the screw cap past the second set of seal flanges.

20. The multi-component cartridge of claim 16, wherein the at least one sealing edge is pre-tensioned in part by the seal flange including the sealing edge being bent in an inward direction toward with respect to at least one of the inner and outer side of the at least one of the inner and outer outlet tube of the coaxial outlet, respectively.

* * * * *